US006907838B2

(12) United States Patent
Gorman

(10) Patent No.: US 6,907,838 B2
(45) **Date of Patent: *Jun. 21, 2005**

(54) FLOATING STRUCTURES

(76) Inventor: Patrick Henry Gorman, 828 Arkansas St., San Francisco, CA (US) 94107-3356

( * ) Notice: Subject to any disclaimer, the term of this patent is extended or adjusted under 35 U.S.C. 154(b) by 0 days.

This patent is subject to a terminal disclaimer.

(21) Appl. No.: 10/720,885

(22) Filed: Nov. 24, 2003

(65) Prior Publication Data

US 2004/0112267 A1 Jun. 17, 2004

Related U.S. Application Data

(63) Continuation of application No. 10/109,153, filed on Mar. 27, 2002, now Pat. No. 6,651,578.

(51) Int. Cl.[7] ..... B63B 35/44
(52) U.S. Cl. ..... 114/267; 14/27
(58) Field of Search ..... 114/261, 262, 114/264, 265, 266; 14/27, 26, 28

(56) References Cited

U.S. PATENT DOCUMENTS

| | | | |
|---|---|---|---|
| 1,854,336 A | 4/1932 | King | |
| 2,321,677 A | 6/1943 | Higgins | |
| 2,399,611 A | 5/1946 | Armstrong | |
| 2,430,178 A | 11/1947 | Kurfiss | |
| 2,977,612 A | 4/1961 | Frost | |
| 3,160,900 A | 12/1964 | Sedlacek et al. | |
| 3,685,074 A | 8/1972 | Marshall et al. | |
| 4,286,538 A | 9/1981 | Matsui | |
| 4,386,441 A | 6/1983 | Lundholm | |
| 4,487,151 A | 12/1984 | Deiana | |
| 4,561,376 A | 12/1985 | Fitzgerald-Smith | |
| 4,621,385 A | 11/1986 | Gillois | |
| 4,864,958 A | 9/1989 | Belinsky | |
| 5,216,773 A | 6/1993 | Haakonsen | |
| 5,398,635 A | 3/1995 | Tellington | |
| 5,588,387 A | 12/1996 | Tellington | |
| 5,799,603 A | 9/1998 | Tellington | |
| 5,906,171 A | 5/1999 | Kristensen et al. | |
| 6,651,578 B1 * | 11/2003 | Gorman | 114/267 |

FOREIGN PATENT DOCUMENTS

| | | |
|---|---|---|
| JP | 06144362 A | 5/1994 |

* cited by examiner

*Primary Examiner*—Jesus D. Sotelo
(74) *Attorney, Agent, or Firm*—Duane Morris LLP

(57) ABSTRACT

Floating structures are provided. The floating structures are suitable for use as floating runways for aircraft, floating roadways, and supports for other facilities. The floating structures include a deck and one or more pontoons attached to the deck. The pontoons, with the deck attached, are caused to float in water contained in a basin, which in turn floats in a body of water. The basin provides damping or isolation of forces due to currents in the body of water, or prevailing winds, to reduce undesired or excessive motion of the deck. The deck supports are preferably capable of limited lateral movement relative to the pontoons, thereby permitting some movement of the pontoons independently and reducing stresses on the structure.

20 Claims, 5 Drawing Sheets

FLOATING STRUCTURES

RELATED APPLICATIONS

This application is a continuation of application Ser. No. 10/109,153, filed Mar. 27, 2002 now U.S. Pat. No. 6,651,578.

FIELD OF THE INVENTION

The present invention relates to floating structures. In particular, the present invention relates to floating structures useful for maintaining platforms supporting airplane runways, bridges, or other structures afloat in bodies of water.

BACKGROUND OF THE INVENTION

Constraints such as shortages of available land when there is a need to locate a structure, either temporarily or permanently, either adjacent to land, or in a large body of water, have led to the development of floating platforms and the like that can support a structure on a body of water. For example, floating runways such as that disclosed in U.S. Pat. No. 5,906,171 provide water-borne surfaces for aircraft to land and take off, similar to surfaces on aircraft carriers. Floating airports, such as that disclosed in U.S. Pat. No. 5,398,635, can further include means for controlling the position of a floating airport by compensating for disturbances to such position by prevailing winds and currents. Complex structures, such as those disclosed in U.S. Pat. No. 5,799,603, have also been developed to provide stability under ocean conditions. According to the disclosure of the '603 patent, energy due to striking waves is partly absorbed by a buoyant load-bearing assembly that includes universal joints and shock-absorbing hydraulic cylinders.

Similarly, floating bridges and roadways have been developed for use in, for example, locations where conventional bridge construction and/or maintenance would be undesirably costly or difficult, or where a relatively short bridge span is required. The ability to transport such floating bridges to a site has been facilitated by utilizing foldable hulls, as described in U.S. Pat. No. 4,561,376, or by providing an amphibious vehicle that can be equipped with hulls and can function as a bridge or portion thereof, as described in U.S. Pat. No. 4,621,385. Such structures, while portable, are apparently somewhat complex.

It will be appreciated that in any geographic area adjacent to bodies of water, where land is scarce or not available for development, floating platforms may be desirable. Development of additional permanent or temporary facilities for manufacturing, power generation, housing or other commercial use may be desirable, but not practical in view of land use policies or community opposition. In the international context, there may be a need for facilities, such as airfields and housing facilities, for military and/or relief efforts, which cannot be located on land because of political and security concerns.

A need remains for floating structures supporting floating platforms suitable for use as aircraft landing strips, airports, roadways, bridges and off-shore facilities. A need also remains for such floating structures that are not subject to some motion caused by waves or water currents as to fail to be functional for their intended purposes. The present invention is directed to these and other objectives.

SUMMARY OF THE INVENTION

One aspect of the invention is a floating structure comprising at least one deck; one or more flotation means attached to and supporting the deck; means for reducing the effects of currents in a body of water on the flotation means; and mooring means for restricting translational motion of the floating structure. In some embodiments, the means for reducing the effects of currents include ballast means for controlling flotation of the structure in a body of water; and mooring means for restricting translational motion of the floating structure.

A further aspect of the present invention is a floating structure that includes at least one deck having an upper surface and a lower surface; one or more pontoons having an interior chamber, attached to and supporting the deck; and a basin. The pontoon chamber is of sufficient volume to cause the deck, the pontoon and its load to float. The basin contains basin water that surrounds the pontoons, and has an open top, and the pontoons float in the basin water. The basin has a chamber of sufficient size to cause the basin to float in a body of water. Preferably, the basin has a wall sufficiently high to isolate the basin water from the body of water.

In some embodiments, the deck has at least two ends, the ends each being attached to a substantially fixed structure, thereby forming a bridge. Preferably, each of the ends contacts the substantially fixed structure, such that a vehicle may be driven from the deck to the substantially fixed structure.

The basin may have a plurality of walls, or a single substantially cylindrical wall. In some embodiments, the basin wall has one or more gates therein. The gate allows for the passage of pontoons and/or basin water into or out of the basin.

Another aspect of the present invention is a method for providing a floating bridge. The method includes providing one or more floating basins having basin water therein; providing one or more pontoons floating in the basins; providing, on the pontoons, a deck having an upper surface and at least two ends; and attaching each of said at least two ends to a substantially fixed structure, thereby forming a bridge between said fixed structures. In some embodiments, the deck is movable with respect to the pontoons. The floating structure may comprise a plurality of basins, which may contain ballast.

A further aspect of the invention is a method for providing a floating runway. The method includes providing one or more floating basins having basin water therein; providing one or more pontoons floating in the basins; and providing, on the pontoons, a deck for supporting the runway. The deck may be movable with respect to the pontoons.

In some embodiments, one or more basin walls has attached thereto a mooring line. The mooring line may be removably attached to a fixed structure such as a pier.

These and other aspects of the invention will be apparent to one skilled in the art in view of the following description and the appended claims.

DETAILED DESCRIPTION

The present invention provides floating structures, also referred to herein as "floating platforms", that are useful, for example, for airports, bridges, causeways, manufacturing facilities, electrical generating facilities, recreational and entertainment facilities, residential structures, waste disposal facilities, and other facilities. The floating platforms are particularly suited for airports, including airport runways, and aircraft landing strips because the structure of the platforms reduces the degree of motion caused by conditions such as prevailing winds, currents and tides in bodies of water, as compared to conventional floating structures such as barges and ships. The floating platforms are also particularly useful for bridges between land masses or between fixed or floating manmade structures.

A floating structure as disclosed herein includes at least one deck; one or more flotation means attached to and supporting the deck; and one or more means for reducing the effects of currents in a body of water on the flotation means. The floating structure may also include a mooring means for restricting translational motion of the structure. The flotation means preferably includes one or more pontoons. The means for reducing the effect of currents may be a floating enclosed basin.

Figure 1:
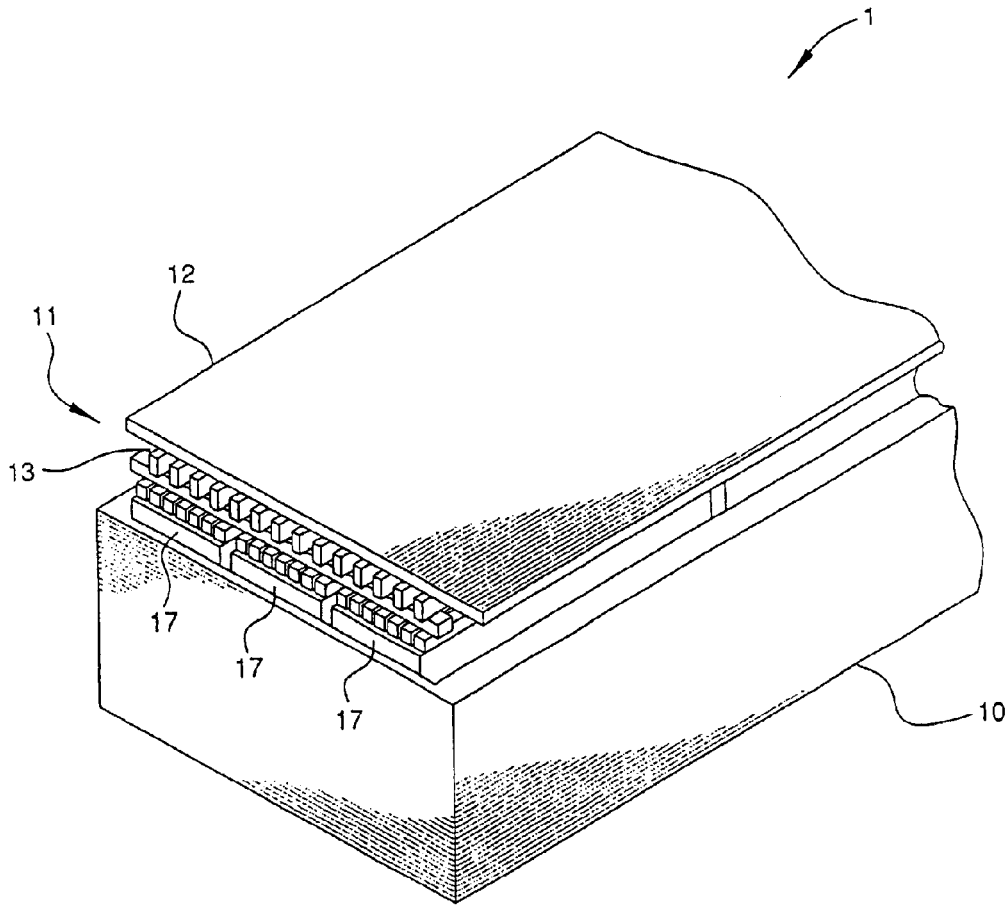
FIG. 1 is a simplified partial isometric view of an embodiment of a floating structure in accordance with the invention.
Figure 2:
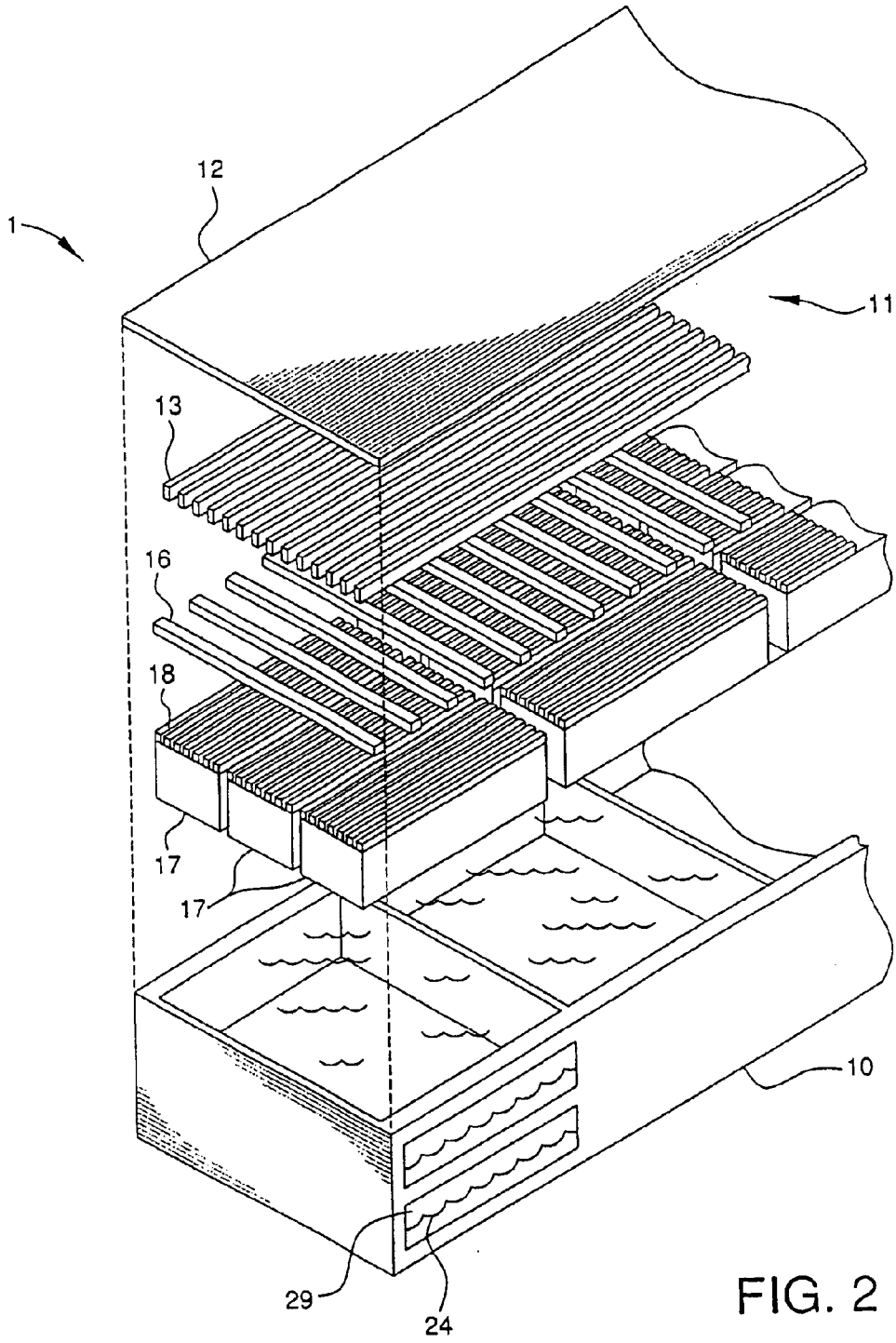
FIG. 2 is an exploded partial isometric view, with partial cutaway, of the floating structure of FIG. 1.
Figure 3:
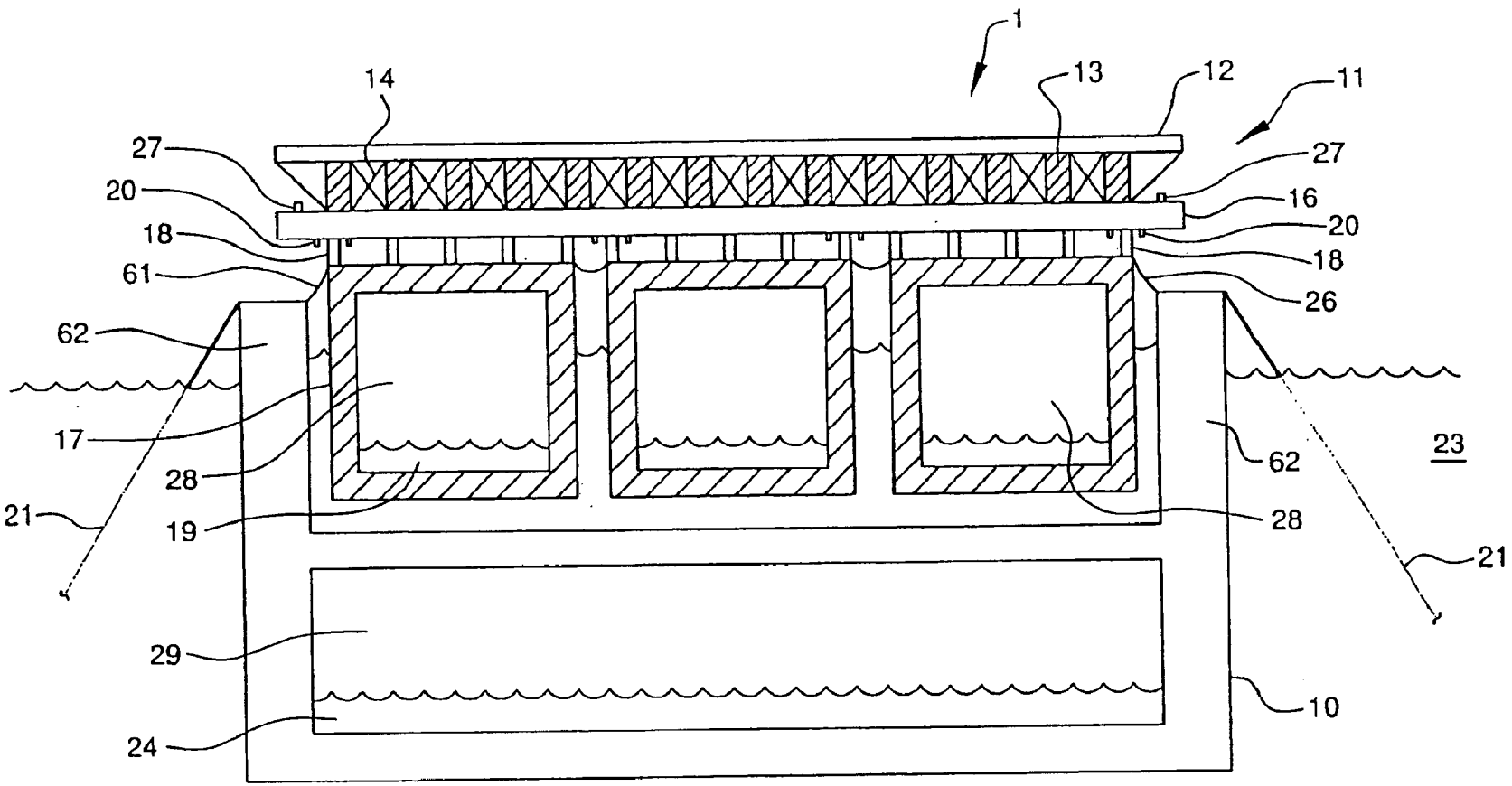
FIG. 3 is a partial sectional view of the structure of FIG. 1.

The floating structures are now described with reference to the drawings, which illustrate preferred embodiments of the invention. In FIG. 1 is shown a simplified partial isometric view of a floating structure 1. FIG. 2 is a simplified exploded partial isometric view of floating structure 1, with a partial cutaway. Floating structure 1 includes, generally, floating basin 10, pontoons 17, and deck 11. Deck 11 is a generally rigid body, has a generally planar horizontal upper surface which includes runway 12, and a rigid lower surface. The lower surface of deck 11 is preferably defined by the lower surfaces of ventral longitudinal ribs or beams 13. Although ventral longitudinal beams 13 are shown in FIG. 2 as separate from runway 12, the separation is only for ease of understanding. In fact, runway 12 and ventral longitudinal beams 13 are preferably integrated in deck 11. Referring specifically to FIG. 3, each ventral longitudinal beam 13 is preferably joined, at least at each end, and optionally at intervals along its length, to the adjacent ventral longitudinal beams 13 by diagonal cables or rods 14, which serve to prevent rotation of longitudinal ribs 13. Pontoons 17 are hollow bodies having an upper surface for supporting a load. Preferably, pontoons 17 have dorsal longitudinal beams 18 integrated into their upper surfaces to provide a load-bearing surface and to transfer the load to upright load bearing walls. Pontoons 17 may also have internal load-bearing vertical beams, walls or similar structures. Bound together by gravity, intermediate pontoons 17 and deck 11 are provided transverse beams 16, which are mounted atop the longitudinal dorsal beams 18 of the pontoons, and upon which ride the longitudinal ventral beams of the deck. The load of deck 11 is transferred to transverse beams 16, which in turn transfer the load to pontoons 17. Ventral longitudinal beams 13 are preferably not rigidly attached to transverse beams 16; rather, ventral longitudinal beams and transverse beams 16 are free to move horizontally with respect to one another, with the range of motion limited by stops 27, for example. The dimensions and locations of stops 27 may be selected to limit the relative movement of the beams as desired. Similarly, transverse beams 16 are preferably not rigidly connected to dorsal longitudinal beams 18, but are movable relative to dorsal longitudinal beams 18 within a range limited by additional stops 27. Alternatively, ventral longitudinal beams 13 and transverse beams 16 may be rigidly connected together; similarly, transverse beams 16 may be rigidly connected to dorsal longitudinal beams 18, so that deck 11 is rigidly connected to pontoon 17. However, deck 11 is preferably movable relative to each pontoon 17. In embodiments wherein deck 11 is movable, stops 27 can be located as desired, to provide a limit to the relative motion of deck 11 on pontoon 17. Deck 11 may be supported on a plurality of pontoons 17. Individual pontoons 17 preferably are not rigidly fixed to one another, but may move relative to one another. Individual pontoons 17 may move relative to deck 11, while still supporting deck 11. This freedom of motion reduces the stress that would otherwise be placed on deck 11 by movement of pontoons 17. Pontoons 17 include a sealed or substantially sealed chamber 28 of a fluid having a density less than that of the fluid in which the pontoon floats. Typically, chamber 28 will be filled with air. The size of chamber 28 sufficient to cause pontoon 17 to float may readily be selected by engineers considering the mass of pontoon 17, the load of deck 11 borne by pontoon 17. Ballast 19 may be included in chambers 28, as illustrated. Alternatively, pontoons 17 may include devices such as ballast tanks (not shown) that allow the degree of submersion of the pontoons 17 to be adjusted. The material of which pontoons 17 are constructed is not critical, and may be any material that can maintain the integrity of chamber 28 and support the portion of the weight of deck 11 borne by the pontoon. The pontoons may be constructed of, for example, reinforced concrete, plastics, composite materials, steel, or other metals. Pontoons 17 are attached to tethers 61, which are in turn attached to wall 62 of basin 10. Tethers 61 restrict the motion of pontoons 17 in basin 10. It will be understood that other structures, such as bladders, padding or the like on wall 62 and/or on sides of pontoons 17 may be employed to restrict the motion of pontoons 17.

Basin 10 is substantially in the form of a container having an open top, and serves to reduce the effects on the pontoons 17 of currents in a body of water 23 into which the flotation means and deck may be placed. Basin 10 has a substantially planar and square base and four generally planar and upright side walls, although other configurations of the base and walls are possible. Basin 10 may contain two or more separate walled chambers 29, as illustrated in FIG. 2. Basin 10 may have a double wall, similar to a double hull of a ship. Basin 10 includes a chamber 29, which is enclosed and of sufficient size that, when filled with air or other selected fluid, to cause basin 10, when filled with water (or other fluid) bearing pontoons floating thereon, to float in the body of water. Chamber 29 may be partially filled with ballast 24, and the volume of ballast in the chamber can be adjusted to control the vertical position of the basin. Alternatively, basin 10 may contain ballast tanks or other structures to adjust the flotation of basin 10. Basin 10 is restricted in its movement by being attached to mooring lines 21, which may be attached to any fixed object of mass substantial enough to remain stationary when basin 10 is moved by currents. Such fixed objects may be pier, pilings, masses of concrete, or other mooring, driven into the floor of the body of water. Mooring lines 21 may be cables or wire, plastic, or other materials, chains of metal or composite, or other high-strength flexible structures and materials. The end of mooring lines 21 at basin 10 may be around driven spools to provide adjustment of the length as desired. In the embodiment shown, the water level in basin 10 is higher than the level of water in the surrounding body of water 23, although it will be understood by one skilled in the art that other variations are possible, wherein the basin water level may be lower than or equal to the level of water in the surrounding body of water. Gates may be provided in the wall 20 for the passage of pontoons 17 into the basin 10.

Figure 4:
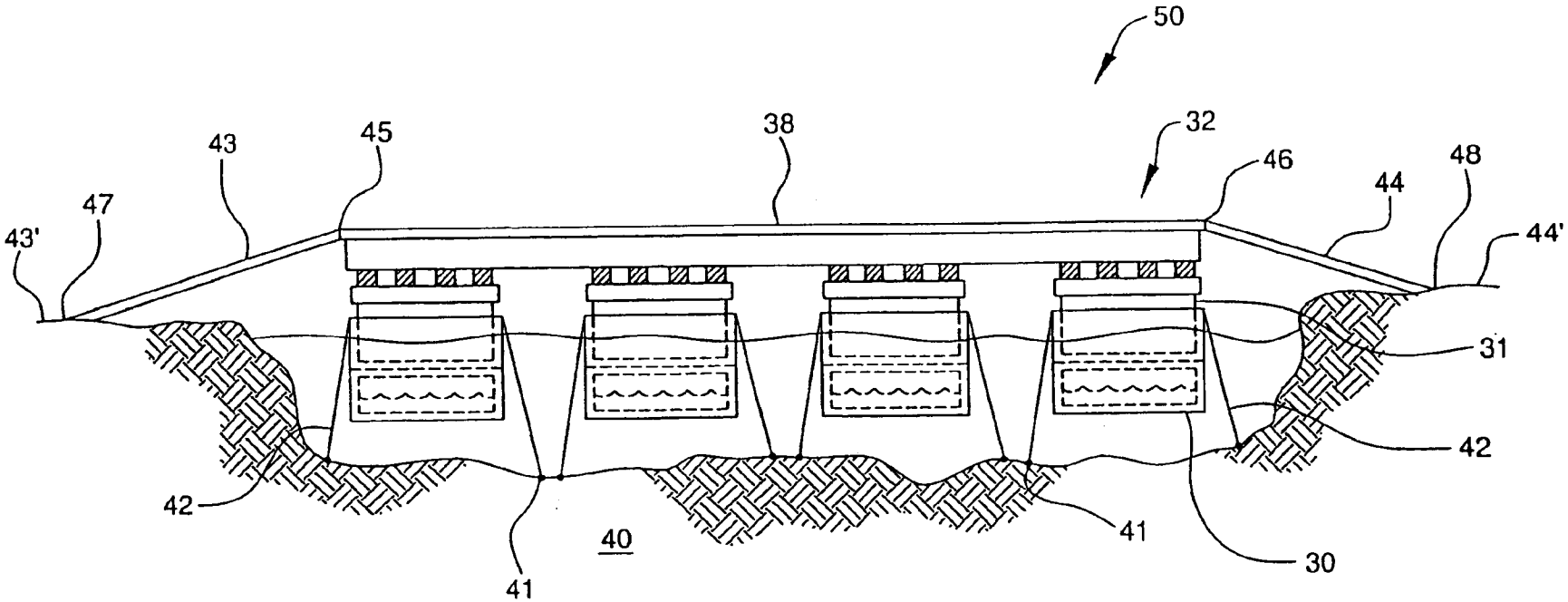
FIG. 4 is a side sectional view of a portion of an alternative floating structure according to the invention.

In FIG. 4 is shown a side sectional view of an embodiment of a floating structure 50 including a roadway. The floating structure includes basins 30, pontoons 31, and a deck 32. Deck 32 is a rigid body having a horizontal, planar upper surface, and has thereon a roadway surface 38, and two end sections 43, 44. The roadway surface 38 may be paved or covered with any suitable material such as asphalt, gravel, concrete and the like. The floating structure is located in a body of water having a bed 40, in which are buried mooring anchors 41 attached to mooring lines 42. Mooring lines 42 have associated therewith devices for adjusting the length of mooring lines 42, which devices may be driven spools. Each end section 43 and 44 of the floating structure contacts land 43' and 44' respectively. End sections 43, 44 are preferably rotatably movable at their connections to deck 32, at 45, 46, and rotatably and slidably movable at their connections to the land, at 47, 48. This permits slight movement of deck 32 in response to movement of basins 30 that is transmitted to pontoons 31. However, because movement of basins 30 is not directly transmitted to pontoons 31, movement of deck 32 is minimized.

Figure 5:
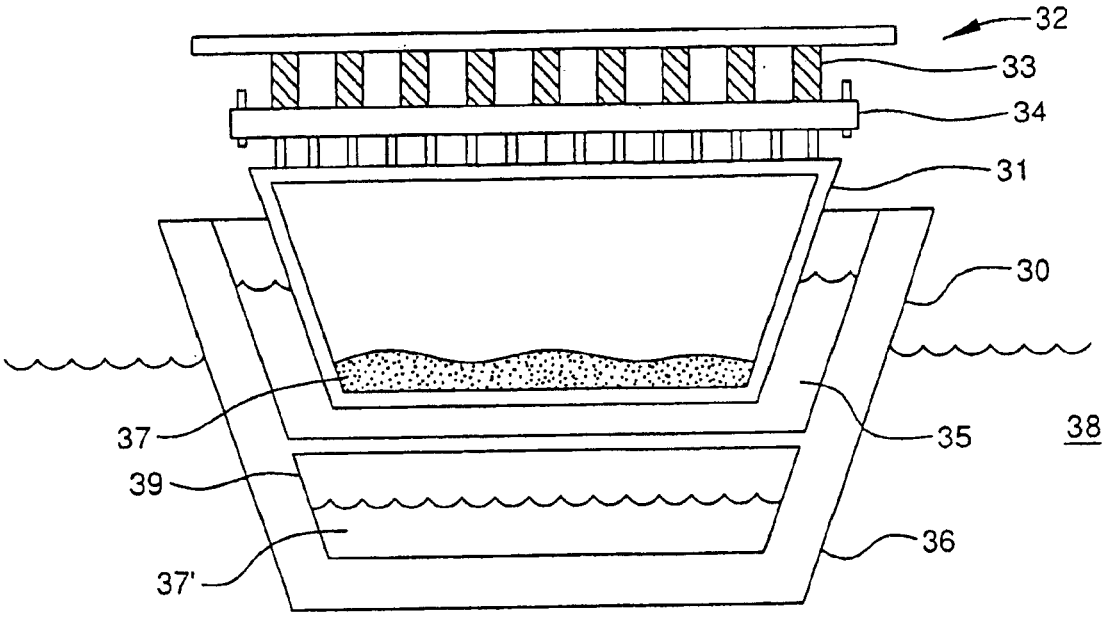
FIG. 5 is a cross-sectional view of a the floating structure of FIG. 4.

Referring to FIG. 5, deck 32 integrally contains and is supported by ventral longitudinal beams 33, which in turn are supported by transverse beams 34. Transverse beams 34 ride atop the longitudinal beams atop the pontoons 31. Basin 30 is similar to basin 10 of FIG. 1, and contains basin water 35, with pontoon 31 floating therein. The design of basin 30 may include the alternatives discussed above with respect to basin 10. The water level of basin water 35 is higher than that of the body of water 38. In the embodiment shown, the basin has a double wall 36. Basin 30 has a sealed chamber 39 containing air or other suitable fluid to provide flotation and ballast 37' located therein. Pontoon 31 has a sealed chamber, with ballast 37 therein for adjusting flotation. It will be understood that pontoons 31 may be fixed with respect to deck 30, or may have a range of motion, thereby reducing stresses on deck 30.

The present invention also provides a method for providing a floating bridge. The method includes providing one or more floating basins as discussed above, having basin water therein; providing one or more flotation means, such as pontoons, floating in the basins; and providing on the pontoons a deck. If desired, the floating bridge may be assembled in a first location and transported to a second location for use. Basins may be provided with basin water at a first location, have one or more pontoons placed in the basin water and secured, and be transported to a second location. During transport, the basins may be temporarily attached together, by ropes or chains, which would then be removed at the second location. During use, basins 30 may be moored together by mooring lines such as ropes or chains, as well as individually moored to mooring devices such as piles or concrete masses buried in the floor of the body of water. A deck may be fabricated at another location and transported to the bridge location, such as by barge, or may be assembled at the bridge location. The deck is placed on the pontoons. A load transfer means, such as transverse beams of the above embodiments, may be provided intermediate the deck and the pontoons. The deck may be positioned so that stops on the deck and/or pontoons restrict the relative motion of the deck and pontoons. End sections are secured between the ends of the decks and the land. Alternatively, the end section may be a section of elevated roadway that suitably contacts deck 32. End sections 43, 44 may be fabricated together with deck 32 at a remote location, and may be maintained in a retracted or rotated position on deck 32 until such time as it is desired for the end sections to complete the roadway. The deck may have been previously provided with a roadway surface, or a suitable surface may be added after placement of the deck on the pontoons.

Also provided according to the invention is a method for providing a floating runway. The method includes providing one or more floating basins 10 having basin water at level 22 therein; providing one or more flotation means, such as pontoons 17, floating in the basin 10; and providing on the pontoons a deck 11 for supporting a runway 12. Load transfer means, such as transverse beams 16, may be provided intermediate deck 11 and pontoons 17. The basins may be fabricated at a remote location and floated to a runway location and secured by mooring lines. The pontoons may be placed in the basins either at the runway location or previously. When the basins are properly positioned, load transfer means are placed on the pontoons, and a deck is placed on the load transfer means. A runway surface may have been previously provided on the deck, or may be added after placement of the deck on the pontoons.

As discussed hereinabove, a preferred means for reducing the effects of currents in a body of water on the floating structures described herein includes a basin. The basin floats in a body of water such as a river or ocean, and provides isolation of the deck from currents in the body of water. Basins 10, 30 may contain basin water completely isolated from water in the surrounding body of water. Alternatively, the side walls of basins 10, 30 may contain one or more through holes, so that the basin water flows in and out of the surrounding body of water. This reduces the load borne by the floating chambers in the basin. Flotation of the pontoons in a basin rather than directly in a body of water, such as a bay, river or ocean, provides reduction of effects, such as stress, imposed on the pontoons by forces such as wind or currents as compared to the stress exerted by such forces on a pontoon floating directly in a body of water. This reduces the motion of the deck. The basins may be moored in the body of water. Furthermore, while moored, the basin preferably maintains some freedom of motion. The motion can reduce or dissipate force exerted on the basin, such as by wind or water currents.

If it is desired to move the floating structure, the mooring lines of the basins may be disconnected from the stationary structures. The floating structure as a whole may then be transported by water to a new location. The deck may alternatively be removed, moved separately, such as by barge, to the new location, and replaced on the pontoons at the new location. The deck may be moved in a single section or divided into several sections at the time of removal, and then reassembled at the new location.

In preferred embodiments, the basin has a floor and one or more walls made of sturdy construction materials known in the art, such as, for example, reinforced concrete or steel. In some applications, preferred materials may be resistant to destructive effects such as corrosion, rust, dissolution, decay and breakage. However, the nature of the material or materials employed for the basin is not critical, and suitable criteria may be developed by one of skill in the art for the selection of appropriate material(s). The basin may have four walls and be square or rectangular. However, basins having other shapes may be acceptable or desirable for esthetic or functional reasons. For example, the basin may be substantially cylindrical, having one circumferential upright side wall. The floating structure may include a single basin, or multiple basins.

The preferred depth of a basin for use in accordance with the floating structures described herein is determined, in part, by the weight of the deck and any structures on the deck and flotation means, such as pontoons, and is sufficient to accommodate variations in buoyancy of the deck but sufficiently shallow to allow anchoring of the deck if desired.

The basin may have attached to it one or more mooring lines. For example, a rectangular or square basin may have four mooring lines, one attached at each corner. The mooring lines may be attached to a fixed, non-water borne, structure, such as a pier; or may, at an opposite end, be embedded in concrete and/or be buried in the floor of the body of water. The mooring lines may be removably attached to the basin and/or the fixed structure. The length of the mooring lines is preferably adjustable, and is sufficient to allow the basin to move in response to external forces such as prevailing winds and currents, thereby damping, and preferably substantially absorbing such forces and minimizing their effects on the deck. A driven spool mounted on the basin and associated with each of the mooring lines may be employed to adjust the length of the mooring lines. Alternative to, or in addition to, mooring lines, the basin may have an anchor affixed thereto.

The basin has walls sufficiently high to isolate the basin water contained therein from the body of water in which the basin floats. The walls of the basin may have one or more gates that can be opened to allow passage of the deck and pontoons into and out of the basin. The gates are preferably made of the same as or a similar material to the material of the walls, and preferably provide a substantially watertight seal when closed. The gates may open and close by hinges, or may open by being withdrawn into a void in the wall appropriately sized to accommodate the gate. Opening and closing of the gates is accomplished with a motorized drive or conveyor device.

The basin preferably includes one or more devices such as ballast tanks or containers that allow the degree of submersion of the basin to be adjusted.

The deck has at least one level comprising an upper surface and a lower surface. The upper surface may have one or more structures constructed thereon, such as one or more buildings, scaffolding, walls, and the like. If the structure is used as a runway, then the upper surface comprises one or more runways suitable for landing and takeoff of commercial, military, and/or private aircraft. The runway can be constructed using methods and technology known in the art. The uppermost surface of the deck is of a size sufficient to accommodate aircraft of the size and nature to be landed on the runway. For example, a runway may be about 100 meters wide or more, and about 1000 meters long or more. In addition to the runways, one or more service buildings may be on the upper surface of the deck. The deck supporting a runway is preferably supported on a plurality of basins, which may be arranged in one or more lines in a body of water. The use of multiple basins permits each basin to move independently in response to varying currents in the body of water. The movement of the pontoons in the basins, and the freedom of movement of the deck with respect to each of the pontoons, permits the basins to move independently of one another, within a limited range, without placing stresses on the structure of the deck.

In some embodiments, the floating structure includes two or more decks, including a top deck and one or more additional decks below the top deck. In embodiments in which the floating structure has more than one deck, the uppermost surface of the top deck can include a runway, and one or more lower decks can accommodate structures such as ticketing areas, administrative offices, storage, docks for accommodating ships transporting supplies and removing trash and other waste, baggage handling and sorting areas, waiting areas, shops and restaurants, and the like. If the floating structure has industrial facilities, such as manufacturing or power-generation plants, the structure may include manufacturing buildings, warehouse structures for supplies and/or finished goods, office space, and waste treatment and storage facilities for example. A power generating facility may be linked by high tension wires on supports on individual smaller floating platforms intermediate the power generating facility and the shoreline, or on a permanent or floating bridge or causeway. In embodiments in which the floating structure includes a roadway, the structure can have two decks, thus providing two road surfaces for use by, for example, vehicles traveling in opposite directions. In the embodiment of FIG. 3, in place of or in addition to a roadway, the upper surface of the floating structure may include a supporting roadbed and tracks to accommodate rail transit, such as light rail or trains. It will be appreciated that a wide variety of structures may accommodated on the decks of the disclosed floating structures, and that the foregoing are merely exemplary.

Although the invention has been described in terms of exemplary embodiments, it is not limited thereto. Rather, the appended claims should be construed to include other variants and embodiments of the invention, which may be made by those skilled in the art without departing from the scope and range of equivalents of the invention.

What is claimed is:

1. A floating structure comprising:

at least one deck having an upper surface;

one or more pontoons, said one or more pontoons supporting said deck; and a basin containing a first ballast material, at least a portion of said one or more pontoons being positionable within the basin and being supportable by said first ballast material, said basin being configured to float in a body of water, said basin further having a wall to isolate the first ballast material from the body of water, said pontoons having at least one degree of freedom of motion relative to said basin.

2. The floating structure of claim 1, wherein said upper surface of said deck comprises a generally horizontal upper surface.

3. The floating structure of claim 1, further comprising a plurality of basins, at least one of said pontoons being at least partially disposed within one of the plurality of basins.

4. The floating structure of claim 1, wherein at least one of said plurality of basins is moored to a fixed structure.

5. The floating structure of claim 4, wherein said fixed structure is a pier.

6. The floating structure of claim 1, wherein the first ballast material comprises water.

7. The floating structure of claim 1, wherein the one or more pontoons have an interior chamber that is at least partially filled with a second ballast material.

8. The floating structure of claim 7, wherein the second ballast material has a composition different from that of the first ballast material.

9. The floating structure of claim 7, wherein the basin has an interior chamber that is at least partially filled with a third ballast material, the interior chamber being separated from the first ballast material.

10. The floating structure of claim 9, wherein the one or more pontoons and the basin are configured to allow the quantity of ballast material in the respective interior chambers to be adjusted.

11. A floating structure comprising:

at least one deck having an upper surface;

one or more flotation means attached to and supporting said deck;

means for reducing the effects on said flotation means of motions in a body of water, said flotation means having horizontal freedom of movement relative to said means for reducing the effects; and mooring means for restricting translational motion of said structure.

12. The floating structure of claim 11, wherein said upper surface of said deck is generally horizontal.

13. The floating structure of claim 11, wherein said means for reducing the effects on said flotation means of motions in a body of water comprises a plurality of basins.

14. The floating structure of claim 11, wherein said floating structure is moored to a fixed structure.

15. The floating structure of claim 14, wherein said fixed structure is a pier.

16. A method for providing a floating surface, comprising:

providing one or more floating basins having fluid contained therein;

providing one or more pontoons floating in said basins, each of said pontoons having at least some horizontal freedom of motion relative to said basins; and providing a deck over said pontoons for supporting said floating surface.

17. The method of claim 16, wherein said floating surface comprises a runway for aircraft.

18. The method of claim 16, wherein at least one of said basins is moored to a fixed structure.

19. The method of claim 18, wherein said fixed structure is a pier.

20. The method of claim 16, wherein said floating surface comprises a roadway.

* * * * *